US005486812A

United States Patent [19]

Todd

[11] Patent Number: 5,486,812

[45] Date of Patent: Jan. 23, 1996

[54] SECURITY ARRANGEMENT

[75] Inventor: Robert E. Todd, Blythe, Great Britain

[73] Assignee: Cedardell Limited, Hexham, United Kingdom

[21] Appl. No.: 927,651

[22] PCT Filed: Feb. 4, 1991

[86] PCT No.: PCT/GB91/00160

§ 371 Date: Oct. 26, 1992

§ 102(e) Date: Oct. 26, 1992

[87] PCT Pub. No.: WO91/14245

PCT Pub. Date: Sep. 19, 1991

[30] Foreign Application Priority Data

Mar. 3, 1990 [GB] United Kingdom ..... 9004828
Oct. 18, 1990 [GB] United Kingdom ..... 9022698

[51] Int. Cl.[6] ..... G08B 1/08

[52] U.S. Cl. ..... 340/539; 340/505; 340/542; 340/825.54; 70/263; 70/264

[58] Field of Search ..... 340/539, 531, 340/506, 505, 542, 543, 825.31, 825.54, 825.06, 825.07, 825.69, 825.72, 825.75, 825.76, 825.32; 70/DIG. 6, DIG. 20, DIG. 49, 262, 263, 264, 277, 275, 222, 223, 92

[56] References Cited

U.S. PATENT DOCUMENTS

| | | | |
|---|---|---|---|
| 3,350,687 | 10/1967 | Gabrielson et al. | 340/825.1 |
| 3,445,815 | 5/1969 | Saltzberg et al. | 340/825.54 |
| 3,882,465 | 5/1975 | Cook et al. | 340/825.54 |
| 4,638,453 | 1/1987 | Gran et al. | 364/900 |
| 4,703,451 | 10/1987 | Calabrese | 340/825.07 |
| 4,792,946 | 12/1988 | Mayo | 370/86 |
| 4,831,374 | 5/1989 | Masel | 340/825.31 |

FOREIGN PATENT DOCUMENTS

| | | |
|---|---|---|
| 0229198 | 7/1987 | European Pat. Off. . |
| 0237457 | 9/1987 | European Pat. Off. . |
| 2131869 | 6/1984 | United Kingdom . |
| 2215387 | 9/1989 | United Kingdom . |
| 2223531 | 4/1990 | United Kingdom . |

*Primary Examiner*—Donnie L. Crosland
*Attorney, Agent, or Firm*—Madson & Metcalf

[57] ABSTRACT

A security arrangement for a building comprises a control module, an alarm and a multiplicity of stations each station being actuated upon receipt of a signal from the control module, each station incorporating a detector adapted to provide a signal indicative of the status of the station, the stations further comprising locks or other security devices, the control module being arranged to actuate the alarm on detection of unauthorized status of the station.

13 Claims, 3 Drawing Sheets

SECURITY ARRANGEMENT

This invention relates to a security arrangement for a building or other article such as a fixture which may incorporate doors, windows or other closures which may be secured to prevent access by unauthorised personnel. The security arrangement may also be used to detect removal or other tampering with valuable articles such as domestic electrical equipment, boats, bicycles and the like.

Conventional security arrangements for domestic or commercial premises incorporate a multiplicity of sensors connected to a control apparatus and alarm, usually by wires which transmit signals when the sensors are actuated to cause the alarm to sound. Such arrangements require the closures associated with respective sensors to be closed and locked prior to actuation of the alarm. One cannot check before switching on the alarm arrangement whether every closure is locked and then close the lock of any which are found to be unlocked without the inconvenience of leaving the control unit to do so.

Electronic security systems for buildings, motor vehicles and the like are normally either active or passive. Passive systems are arrangements which detect the presence of an intruder and sound the alarm. Active systems incorporate locking arrangements operated by a special key or digital code used by or known to authorised personnel. Although there are a great many varieties all of which have similarities in construction and operation, both kinds of arrangement possess significant disadvantages and weaknesses. Passive systems make the inherently dangerous assumption that the building or vehicle to which they are installed has been securely locked. They offer no means of deterring any unauthorised attempt to gain access, apart from the possibility that a person may be dissuaded by an indication of the presence of the alarm, such as an alarm box attached to the exterior of the building. Active systems are only usually found on access doors and do not monitor the building or vehicle to which they are fitted to confirm the effectiveness of the security arrangement.

According to a first aspect of the present invention a security arrangement comprises a control module, an alarm and a multiplicity of stations at least one station including a lock, characterised in that each station is adapted to be actuated upon receipt of a signal from the control module and incorporating a detector adapted provide a signal indicative of the status of the station, the control module being arranged to actuate the alarm upon detection of unauthorised status of the station.

The locks may be fitted to closures including doors, windows and the like, the alarm being responsive to unauthorised opening of the closure. The alarm may also be arranged to indicate whether the stations are in a desired condition for example whether the door or windows of a building are closed but not necessarily locked.

According to a preferred aspect of the present invention each station may incorporate an RF transceiver arranged to transmit and receive signals from the control module. In an alternative embodiment of the invention the station may communicate with the control module by means of electrical or fiber optic conductors.

Further preferred arrangements in accordance with this invention incorporate a plurality of RF transceivers arranged to transmit a signal received from the control module by a first station to an adjacent station in sequence. The stations of a preferred security arrangement may be arranged so that a first station receives a signal from the control module performs a function upon receipt of the signal, passes the signal to an adjacent station which in turn performs the function before relaying the signal to a third station, the signal being relayed to each station in turn and then returned to the control module to complete the cycle.

In use of a preferred embodiment the signal emitted from the control module is modified by each station in turn so that the signal returned to the module after each complete cycle provides an indication of the status of all of the stations. The frequency with which the signals are emitted by the module and their direction around the circuit may be varied either at random or in accordance with a predetermined sequence. This serves to frustrate attempts to interfere with the signals, for example by insertion of a dummy station to replace a broken lock.

The alarm may be actuated by receipt of a single incorrect signal. Preferably the module is arranged to interrogate each station frequently, for example every few seconds, the alarm is not being actuated until the incorrect signal has been confirmed several times. This serves to reduce the incidence of false alarms.

The security arrangement of the present invention confers a considerable number of advantages. The RF transceivers need only have a low power and minimal range, avoiding any interference with external equipment and any necessity for a broadcasting licence. The signal may be modified as it is received by each station so that the control module receives a discrete indication of the status of each lock or other function performed by the station. Thus a fault or alarm condition may be correlated with the station concerned, allowing rapid identification and correction of any security hazard. Deactivation or removal of a station from the circuit would also cause actuation of the alarm.

In preferred aspects of the invention a station including an RF transceiver may be attached to or placed in a valuable article located in the vicinity of the RF circuit, but not necessarily secured to a lock assembly. Such articles may include a car, boat, caravan or fop a building such as a garage which is remote from the main building. Removal of a car for example from the vicinity of the central module would thus cause actuation of the alarm. Similarly the station may be adapted to be connected to an electrical circuit of the vehicle, for example the ignition circuit or an existing alarm arrangement to provide a remote indication that the vehicle has been tampered with by an unauthorised person. Thus the person may not be alerted by the presence of an audible alarm increasing the likelihood of his apprehension. Alternative articles to which the station may be attached are valuable electrical items such as video recorders, television sets, and the like. In such circumstances the transceiver may be adapted to transmit a signal through the mains supply to the building, avoiding the need for an RF circuit and also providing an alarm if the mains supply to the article is interrupted. The station may be integral with the mains supply connector.

The controller of the present invention may be arranged to communicate with a radio pager or other apparatus remote from the building. A telephone unit may be provided so that the control module can be interrogated by means of a telephone call from a remote location. This affords the benefit that a security monitoring service may be provided to check the integrity of the security system while the owner is absent, for example abroad on holiday. The frequency of interrogation of the circuit may be selected as desired, a brief telephone call being all that is necessary to ascertain the status of the security system.

The key used to gain access to the building or other closure within the security circuit may contain an integral RF unit arranged to deactivate the alarm as the key is brought into the proximity of the lock. This avoids any necessity for a user to manipulate the alarm each time they enter or leave the house. This feature provides a clear benefit for elderly or otherwise infirm person who may not remember to activate the alarm or may not have the dexterity or desire to do so.

Smoke detectors, petrol vapour or orther hazardous compound detectors or passive infra-red proximity detectors or active proximity detectors may be incorporated within the circuit of the present invention.

The control unit may incorporate an integral power supply. The control unit may also incorporate a number of rechargable batteries suitable for use in replacement of the power supplies for the locking units. The locking units may be arranged to provide a signal when their batteries or other power supplies lose power or require replacement. This avoids any malfunction of the system in the event of exhaustion of the battery supply.

The security system may be arranged to provide various functions dependent on whether the user has left the house. Thus if the alarm is actuated but an external door is not opened and closed, indicating that the house is still occupied, the system may simply lock the ground floor doors and windows, leaving the upstairs bedroom windows free to be opened during the night without actuation of the alarm.

The invention is further described by means of example but not in any limitative sense with reference to the accompanying drawings of which:

Figure 2:
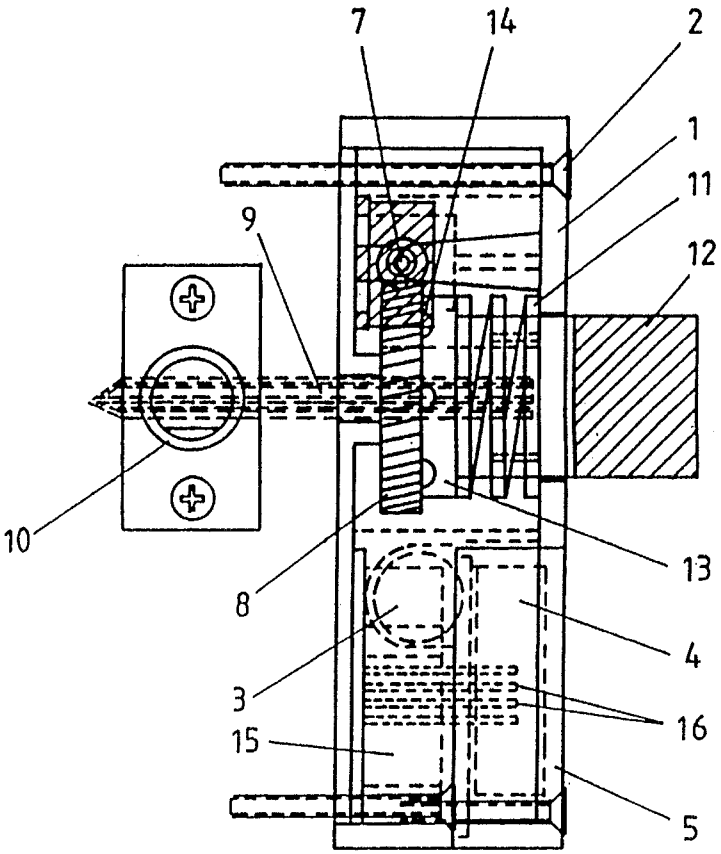
FIG. 2 is a perpendicular cross section through the door lock of FIG. 1.
Figure 1:
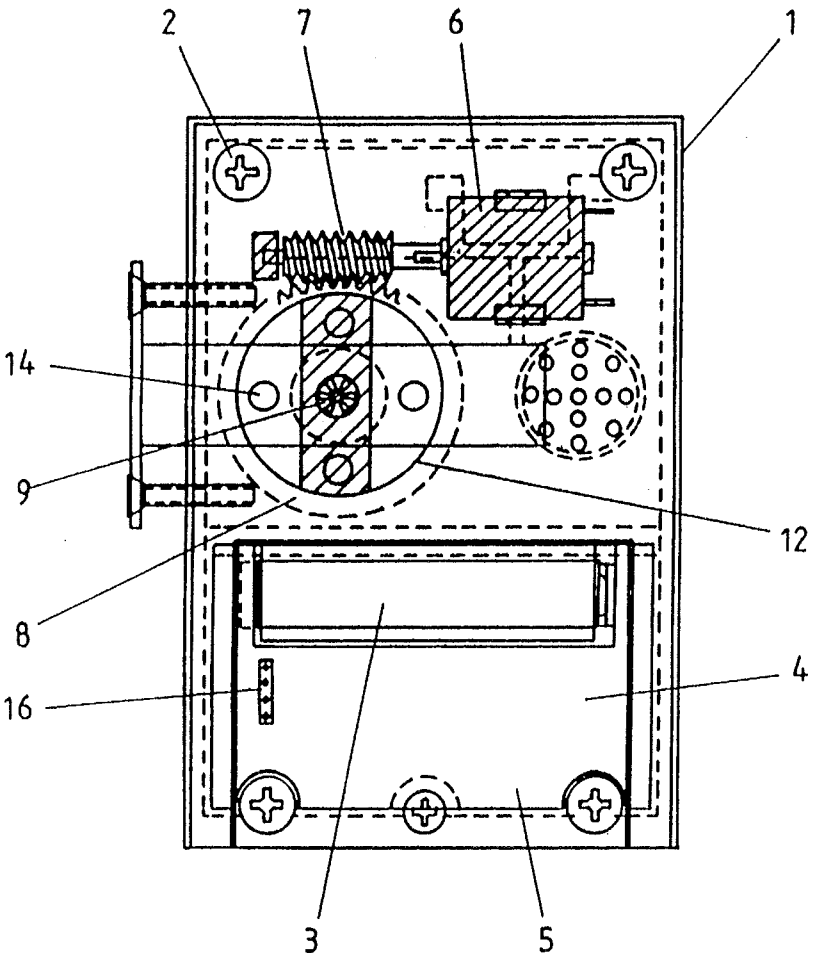
FIG. 1 is a cross-section through a door lock in accordance with this invention.

A lock shown in FIGS. 1 and 2 comprises a casing 1 adapted to be secured to a door by means of screws 2 in conventional manner. A battery 3 is arranged to power a RF transceiver 4 removably secured to the casing 1 by means of a screw fastened panel 5. The motor 6 is arranged to drive a gear 7 by means of a worm screw 8. Actuation of the motor causes rotation of the gear 8 driving a shaft 9 axially of the gear 8 causing engagement or withdrawal of the shaft or latch 9 within a socket 10 disposed in the door frame. Engagement of the shaft 9 within the socket 10 serves to lock the door. A spring 11 acting against a hand grip 12, urges a clutch plate 13 against domed projections 14 upon the gear 8. This provides a slipping clutch arrangement so that when the knob 12 is depressed against the plate 13, the gear 8 may be rotated causing the shaft to be withdrawn or engaged within the recess 10. This serves to provide for manual operation of the lock in the event of a power failure or in other circumstances. A logic circuit 15 is connected to the transceiver 4 by contact pins 16 which engage contacts on the gear 8 to provide signals indicative of the latter being in the open and closed states. Logic circuit 15 also includes a reed switch or Hall effect sensor responsive to a magnet located in the door frame to provide a signal indicative of the door being closed whether,locked or unlocked.

Figure 3:
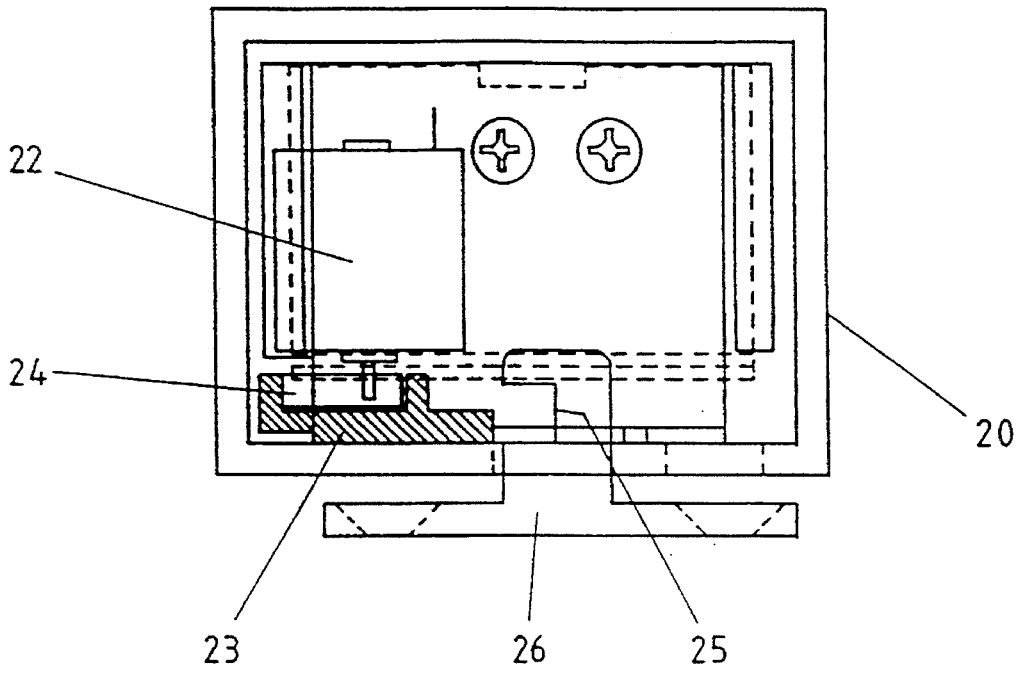
FIG. 3 is a cross-section through a window lock in accordance with this invention.
Figure 4:
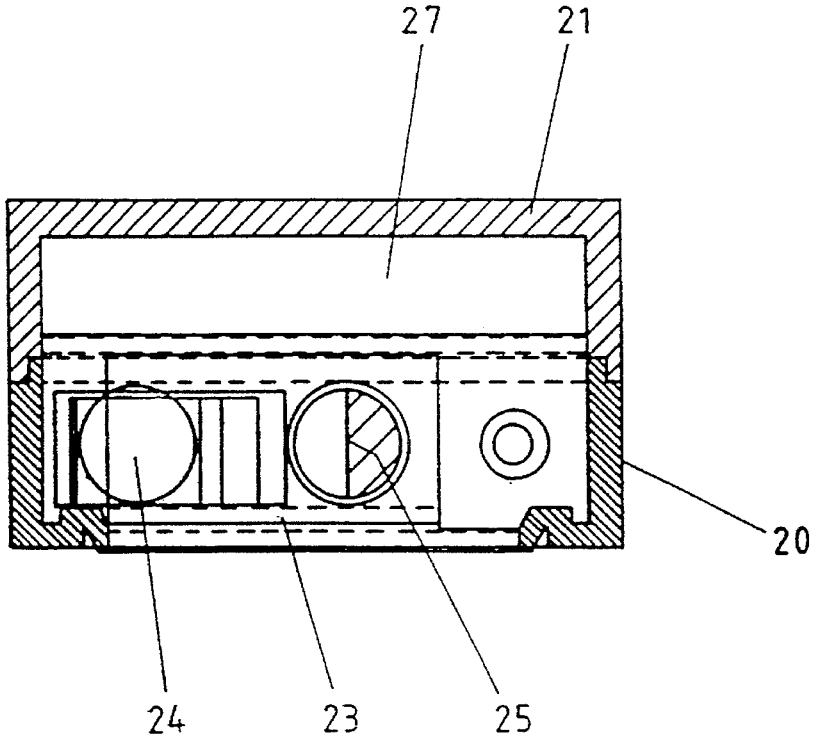
FIG. 4 is a perpendicular cross-section through the window lock of FIG. 3.

FIGS. 3 and 4 illustrate a window lock in accordance with this invention. Casing 20 including a removable cover 21, contains a motor 22 arranged to drive an eccentric circular cam 24 located in a socket in a slidable latch 23. A catch 26 adapted to be secured to a window frame includes a rebate 25 to receive the slidable latch 23 when the lock is closed. An RF transceiver and logic circuit 27, accessible by means of the cover 21 controls opening and closing of the lock and is responsive to sensors indicative of the status of the lock. A Hall effect device or reed switch (not shown) contained within the casing 20 is responsive to a magnetic strip (not shown) secured to the window frame, for example beneath the catch 26, to provide an indication of the open or closed status of the window closure.

Figure 5:
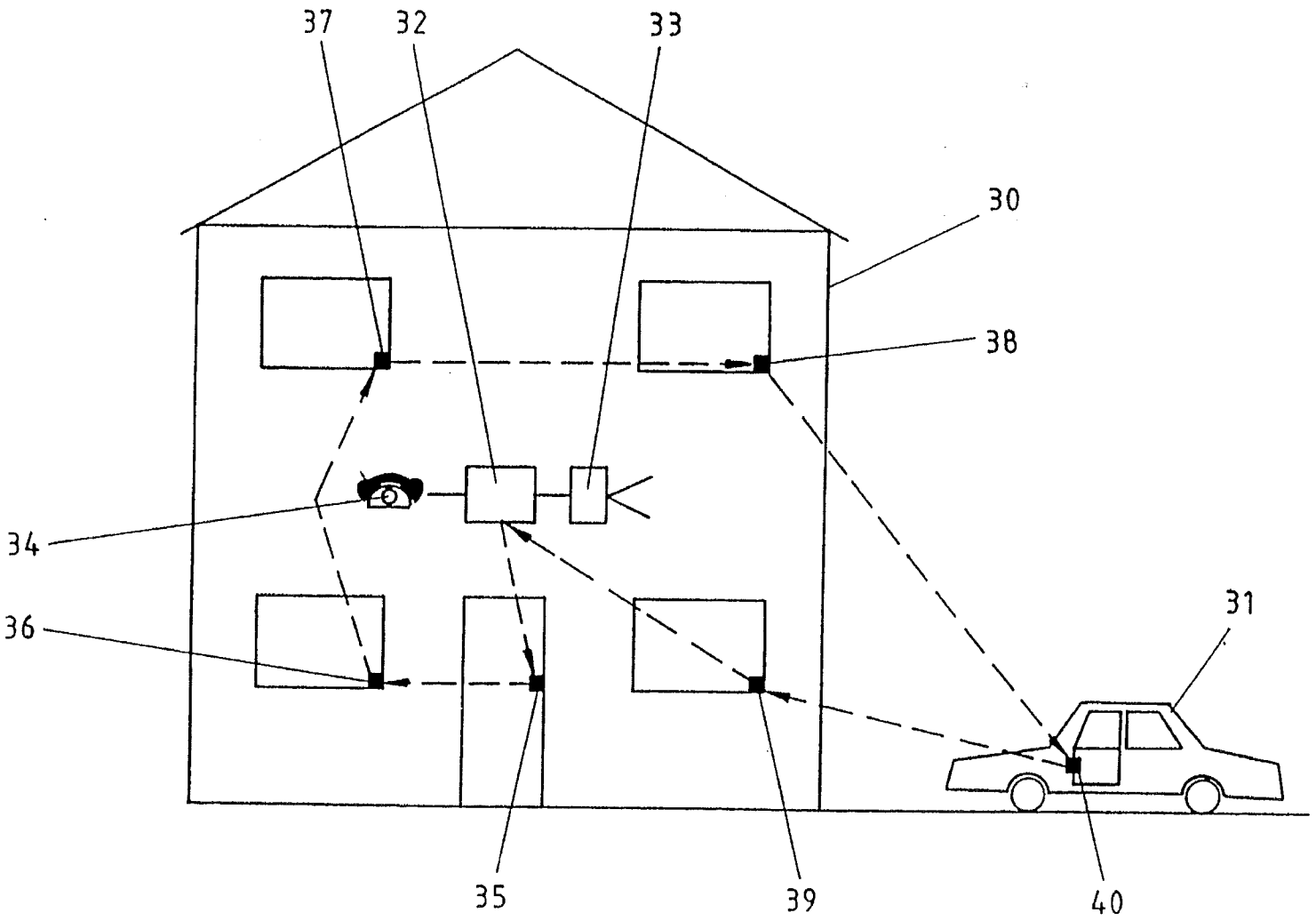
FIG. 5 is a diagrammatic arrangement in accordance with the invention.

FIG. 5 shows a diagrammatic representation of a security arrangement in accordance with this invention. The building 30 and vehicle 31 are protected by means of a security arrangement comprising a control module 32, alarm 33 and telephone system 34 connected by means of a modem. A lock 35 is secured to the exterior door in conventional fashion. Locks 36, 37, 38 and 39 are secured to respective windows and a burglar alarm 40 is connected to the vehicle 31. In use of the apparatus the control module transmits RF signals to the first station integral with the door lock 35. If the lock is in the desired condition, for example locked if the user is leaving the building wishes to lock the building up at night, the signal from the module 32 is modified and relayed to the window lock 36. The status of the window lock is checked and the signal relayed to window locks 37 and 38 at which the process is repeated in turn. The signal 38 is then received by the vehicle alarm 40 which checks that the vehicle is in the desired condition. The signal is then transmitted to the window lock 39 and eventually the cycle is completed by reception of the signal by the control module 32. In preferred embodiments of the invention the signal is transmitted around the circuit at frequent intervals, for example every five seconds. Minimal power is consumed because the RF units at each station are only active for a short period. If one of the locks is not in the desired condition, for example if one has been forced open or if the vehicle 31 has been removed from the vicinity of the security arrangement, the controller is arranged to disregard the alarm condition until it has been confirmed by a predetermined number of further signal cycles. The alarm 33 is then actuated. The control module is connected to a telephone by means of a modem 34 or other linkage. This enables the alarm to be directed to a remote location, for example a local police station or other security point. The telephone 34 also allows the status of the security arrangement to be checked by means of a telephone call. Transmission of appropriate signals through the telephone may also allow the status of the arrangement to be altered without need for entering the building.

I claim:

1. A building security arrangement comprising a control module, an alarm and a multiplicity of stations, at least one station including a lock, wherein each lock is arranged to be actuated upon receipt of a control signal from the control module and wherein said stations include a detector adapted to provide a status signal indicative of a status of the station, a radio frequency transceiver for transmitting and receiving control signals from the control module, and a control signal modifier for modifying the control signal received by the station, the control module being arranged to actuate the alarm upon detection of a predetermined status of a station, whereby the stations are successively interrogated by the control module, and wherein at least one station is arranged to receive a control signal from a first adjacent station, to modify said control signal to indicate the status of the station, and to transmit the control signal to a second adjacent station.

2. An arrangement as claimed in claim 1, wherein said control signal has a direction and wherein the control module includes means for varying said direction.

3. An arrangement as claimed in claim 1, characterized in that a user may actuate the lock upon a single actuation of the control module.

4. An arrangement as claimed in claim 2, characterized in that a user may actuate the lock upon a single actuation of the control module.

5. An arrangement as claimed in claim 1, wherein said control signal has a frequency and wherein the control module includes means for varying said frequency.

6. An arrangement as claimed in claim 4, wherein said control signal has a frequency signal] and wherein the control module includes means for varying said frequency.

7. An arrangement as claimed in claim 1, characterized in that a station is secured to an article selected from the group comprising: a car, boat, caravan and a valuable electrical item.

8. An arrangement as claimed in claim 6, characterized in that a station is secured to an article selected from the group comprising: a car, boat, caravan and a valuable electrical item.

9. An arrangement as claimed in claim 1, characterized in that a station includes a sensor selected from the group comprising: a smoke alarm, a proximity detector and a hazardous compound detector.

10. An arrangement as claimed in claim 8, characterized in that a station includes a sensor selected from the group comprising: a smoke alarm, a proximity detector and a hazardous compound detector.

11. An arrangement as claimed in claim 1, wherein the lock includes a latch actuated in use by a motor, the latch being arranged to be further actuated manually by a slipping clutch.

12. An arrangement as claimed in claim 10, wherein the lock includes a latch actuated in use by a motor, the latch being arranged to be further actuated manually by a slipping clutch.

13. An arrangement as claimed in claim 4, wherein said control signal has a direction and wherein the control module includes means for varying said direction.

* * * * *